US007183978B1

(12) United States Patent
Azar

(10) Patent No.: US 7,183,978 B1
(45) Date of Patent: Feb. 27, 2007

(54) WIDEBAND OMNIDIRECTIONAL ANTENNA

(75) Inventor: Tony Azar, Melville, NY (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 81 days.

(21) Appl. No.: 11/074,133

(22) Filed: Mar. 7, 2005

(51) Int. Cl.
*H01Q 1/38* (2006.01)

(52) U.S. Cl. ..... 343/700 MS; 343/846

(58) Field of Classification Search ..... 343/700 MS, 343/773, 846, 829, 830
See application file for complete search history.

(56) References Cited

U.S. PATENT DOCUMENTS 5,872,546 A * 2/1999 Ihara et al. ..... 343/795
7,027,002 B2 * 4/2006 Suh et al. ..... 343/773

FOREIGN PATENT DOCUMENTS

JP 10150318 A * 6/1998

OTHER PUBLICATIONS

N. P. Agrawall, "Wide-Band Planar Monopole Antennas", *IEEE Transactions on Antennas and Propagation*, vol. 46, No. 2, Feb. 1998, pp. 294-295.

* cited by examiner

*Primary Examiner*—Hoang V. Nguyen
(74) *Attorney, Agent, or Firm*—Kenneth P. Robinson

(57) ABSTRACT

A compact antenna includes a disk-type radiating element normal to a ground plane section. Each face of the radiating element may have a third-dimensional characteristic (e.g., a convex outer surface.) Dielectric material may be positioned on the ground plane forward of each face of the radiating element. In other configurations, the third-dimensional characteristic and dielectric material features may be used separately in antennas arranged to provide omnidirectional performance over a wide frequency bandwidth. An input/output port may be provided by a coaxial-type connector coupled to the radiating element.

14 Claims, 5 Drawing Sheets

WIDEBAND OMNIDIRECTIONAL ANTENNA

RELATED APPLICATIONS (Not Applicable)

FEDERALLY SPONSORED RESEARCH (Not Applicable)

BACKGROUND OF THE INVENTION

The invention relates to antennas and, more particularly, to antennas which are compact in size while providing onmidirectional coverage with wide frequency bandwidth performance.

Small antennas capable of providing omnidirectional coverage over a wide frequency bandwidth have many aircraft and other applications. A previously described type of antenna utilizes a monopole element in the form of a flat faced planar disk of circular configuration, which is supported above a ground plane with its faces normal to the ground plane. Results of testing operational performance of such antennas are provided in an article by N. P. Agrawall, et al., titled "Wide-Band Planar Monopole Antennas", in *IEEE Transactions on Antennas and Propagation*, vol. 46, No. 2, February 1998, pp. 294–295. Based on the test results, this article concludes that while broadband operation is achievable, the radiation pattern of the antenna is subject to degradation at the upper portion of the frequency band (i.e., with reference to a "bandwidth of 2.25–17.25 GHz" it is stated that "the pattern degrades above 12 GHz"). Thus, the form of flat disk antenna described in the article may not be capable of providing the wide frequency bandwidth performance required in some applications.

Objects of the present invention are to provide forms of antennas which are new or improved and which may provide one or more of the following capabilities or characteristics:

- improved wideband performance via E-field enhancement;
- third dimensional radiating element property for E-field enhancement;
- dielectric material inclusion for E-field enhancement;
- omni-directional antenna pattern;
- wide frequency bandwidth;
- suitable gain level uniformity over wide bandwidth; and
- design flexibility to meet implementation requirements.

SUMMARY OF THE INVENTION

Pursuant to one embodiment of the invention, an antenna includes a conductive ground plane section and a radiating element having two faces, each with a three-dimensional outer surface. The faces of the radiating element are bounded by a two-dimensional circumference and the radiating element is positioned with a chord of the circumference nominally perpendicular to the ground plane section. Dielectric material extends above the ground plane section with a portion of dielectric material forward of each face of the radiating element. The antenna includes a feed port coupled to the radiating element via an opening in the ground plane section. As an example, the radiating element may have the form of a circular disk with each face having a convex outer surface, so that the disk thickness at its center is greater than thickness at the circumference.

Pursuant to an additional embodiment, an antenna includes a conductive ground plane sections and a radiating element having two faces bounded by a circumference. The radiating element is positioned with a chord of the circumference nominally perpendicular to the ground plane section. Dielectric material extends above the ground plane section with a portion of dielectric material forward of each face of the radiating element. The antenna includes a feed port coupled to the radiating element via an opening in said ground plane. The dielectric material may, for example, include two blocks of dielectric material with each block positioned on the ground plane section in a forward direction relative to a face of the radiating element.

Pursuant to a further embodiment, an antenna includes a conductive ground plane section and a radiating element having two faces each with a three-dimensional outer surface. The faces of the radiating element are bounded by a two-dimensional circumference and the radiating element is positioned with a chord of the circumference nominally perpendicular to the ground plane section. The antenna includes a feed port coupled to the radiating element via an opening in the ground plane section. As an example, the radiating element may have the form of a disk which is thin at its circumference, has a greater face-to-face thickness at its center, and has a circumference which is one of: a circle, an ellipse, a square, a rectangle, a hexagon, another shape.

For a better understanding of the invention, together with other and further objects, reference is made to the accompanying drawings and the scope of the invention will be pointed out in the accompanying claims

DESCRIPTION OF THE INVENTION

Figure 1:
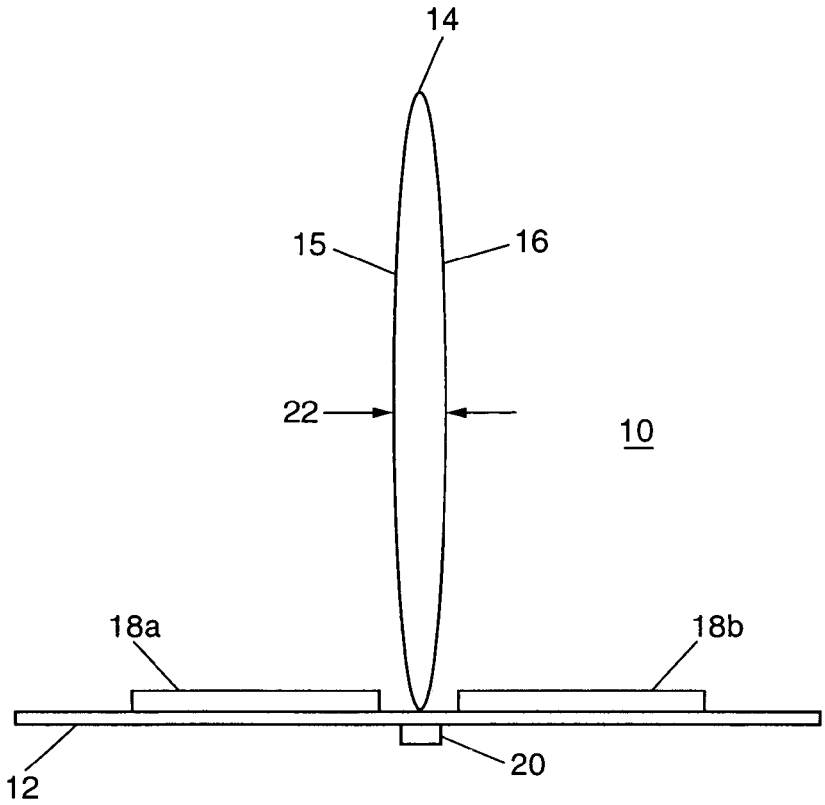
FIG. 1 is a side view (side "edge" view) of an antenna utilizing the invention.
Figure 2:
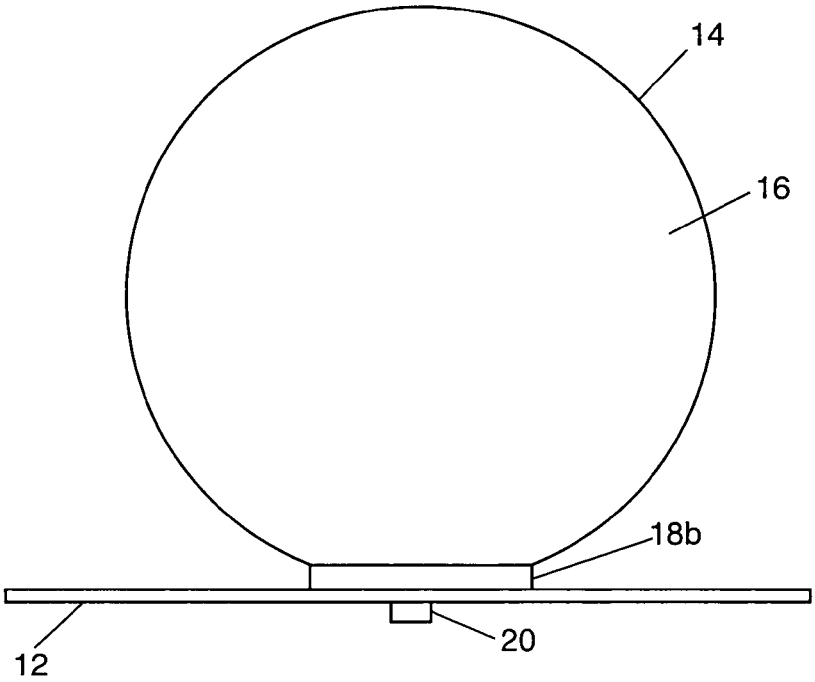
FIG. 2 is a side view (side "front" view) of the FIG. 1 antenna rotated 90 degrees.
Figure 3:
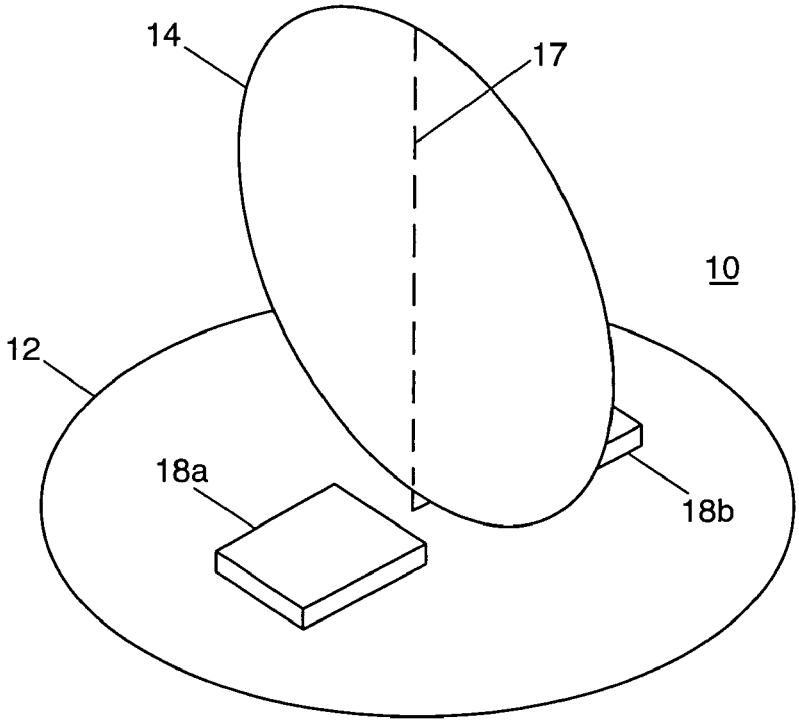
FIG. 3 is an isometric view of the antenna of FIGS. 1 and 2.

FIGS. 1 and 2 are side views (side "edge" and side "front" views, respectively) of one form of an antenna 10 which utilizes the invention. FIG. 3 is an isometric view of this antenna.

Antenna 10 includes a ground plane section 12 in the form of a relatively thin circular element having a conductive upper surface. Ground plane section 12 may be formed of aluminum, a composite or other material or combination of materials with a conductive upper surface provided and may be of any size or shape as may be determined by skilled persons as suitable for a particular implementation.

As shown, antenna 10 includes a radiating element 14 having two faces 15 and 16, which are shown in side view profile in FIG. 1, with a front view of face 16 in FIG. 2. As shown in FIG. 1, each of faces 15 and 16 has a three-dimensional outer surface, illustrated in this example as being convex, so that the radiating element 14 has the form of a circular disk of thickness at its center greater than the thickness at the circular circumference of element 14. In FIG. 1 radiating element 14 is shown as having a face-to-face thickness 22 away from the circumference (e.g., at the center) which is at least three times the thickness at the circumference. As compared to a radiating element in the form of a disk with planar faces (i.e., two-dimensional disk faces), the thickness profile of FIG. 1 provides a third-dimensional characteristic which is effective to provide E-field enhancement for improved performance pursuant to the invention.

Figure 4:
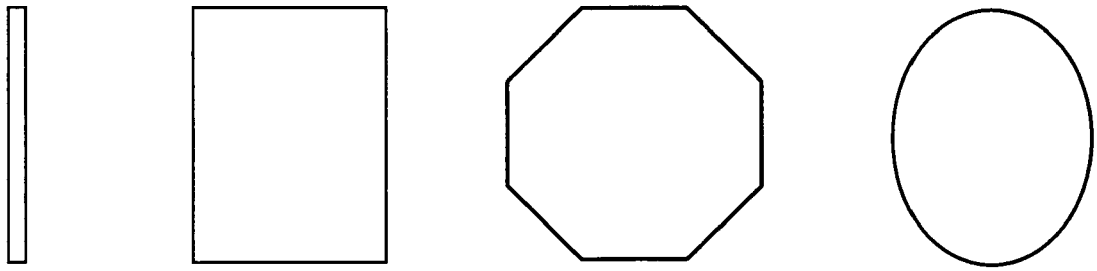
FIG. 4 illustrates certain alternative forms of radiating elements.

Thus, it will be seen that radiating element 14 of the antenna has two faces 15 and 16, each having a three-dimensional outer surface, which in other embodiments may comprise a three-dimensional surface other than a simple convex shape as shown. The faces 15 and 16 are bounded by a two-dimensional (i.e., planar) circumference visible in the side front view of FIG. 1. In the configuration as illustrated, radiating element 14 is positioned with a chord 17 of the circumference of element 14 nominally perpendicular to the ground plane section 12. For purposes of this application, the term "nominally" is defined as covering a range of values within plus or minus fifteen percent or degrees of a stated value or relationship (e.g., plus or minus 15 degrees of perpendicular). In the example under consideration, radiating element 14 has a circular circumference. In other implementations the radiating element may have a circumference which is one of an ellipse, a square, a rectangle, a hexagon, an octagon or another shape suitable for a particular application, as may be determined by a skilled person once having an understanding of the invention. For purposes of illustration, examples of other such shapes are shown in the three views included to the right in FIG. 4.

Antenna 10 as illustrated also includes dielectric material 18, shown as comprising two blocks 18*a* and 18*b* of dielectric material extending above the ground plane section 12. In this example one of the blocks 18*a* and 18*b* is positioned in a forward direction relative to each of the faces 15 and 16 of element 14 and each block extends above the ground plane section by a dimension less than fifteen percent, of the largest dimension (e.g., the height or diameter) of radiating element 14. Thus, while the blocks are forward of (e.g., in front of) each face, as shown, the blocks are not directly in front of the central portions of the faces. As described, in this embodiment the dielectric material 18 comprises two blocks 18*a* and 18*b* which have the form of rectangular solids. In other embodiments the dielectric material may be provided in the form of low circular or elliptical cylindrical sections, as cubes, as a circular or elliptical ring surrounding element 14 at its lower extremity and supported on the surface of the ground plane portion, or in any other suitable form as may be determined by skilled persons with respect to particular implementations. In these configurations pursuant to the invention, dielectric material positioned forward of the radiating element faces is effective to result in a field characteristic providing E-field enhancement for improved performance of the antenna.

Antenna 10, as shown, further includes a feed port 20 coupled to the radiating element 14 via an opening in ground plane section 12. Feed port 20 may comprise any suitable form of coaxial connector (e.g., a type N connector adapted for this use) or any other suitable device. With use of a coaxial connector device for this purpose, the center conductor may be connected to the body of radiating element 14 via a central hole (not visible in these views) and the outer shell of the connector may be connected to the conductive upper surface of ground plane section 12. In use of the antenna, feed port 20 may function as an input/output port for signals coupled via a coaxial cable connected to the feed port.

Radiating element 14 may be of any suitable construction employing a solid metallic form, employing two shaped sheet metal face portions fastened together along their respective circumferences, employing a suitably shaped blank of dielectric or other material with metalized faces, or employing other fabrication techniques to provide a disk-type form of requisite shape as described. As noted, the circumference may be of any shape, regular or otherwise, as may be suitable for use in a particular application. FIG. 1 illustrates each face having a third-dimensional outer surface characteristic (as compared to the two-dimensional nature of a planar disk) provided by provision of a simple convex shape. In other embodiments a third-dimensional characteristic may be provided by use of faces with outer surfaces having other profiles, which may include ridges, spaced protrusions or other features extending from the plane of the circumference of each face, as may be suitable for particular applications. As to fabrication details, the antenna may be positioned within a radome of suitable design, so that physical strength of the radiating element as needed to maintain its vertical alignment during use is reduced. For use with or without a protective radome, radiating element 14 may be constructed to provide sufficient strength for positional stability, supportive struts of suitable design and material may be added to the antenna, or low density foam supports or other support techniques may be employed by skilled persons as appropriate.

In a particular design for operation over a 225 MHZ-2 GHz band, the radiating element had the form of a circular disk resembling that shown in FIGS. 1 and 2 and having a diameter of 26 cm. with a circumferential thickness of about 0.25 cm. and a central thickness 22 of about 1.68 cm. The disk was positioned about 6 mm. above the ground plane. Dielectric blocks 18*a* and 18*b* of material having a dielectric constant of about 6.2 and dimensions of approximately 6.5×8×1 cm. were spaced forward of each face, as illustrated, with a near-edge spacing of about 3 cm. from the feed conductor (e.g., center coaxial conductor of feed port 20).

With this configuration it was determined on the basis of computer simulation and actual test results that the three-dimensional structure of the radiating element faces, together with the dielectric blocks, were effective to provide E-field enhancement and improved performance. The improved performance, as compared to performance of a circular disk with two planar faces, is attributed to the resulting effect of additional components of the E-field of the antenna being implemented parallel to the plane of the circumference of the disk element. The resulting antenna was effective to provide a far field pattern producing nearly uniform omnidirectional performance across the band, including at the highest frequencies, as will be indicated by further figures to be addressed below.

As described, the third-dimensional characteristic of the radiating element faces and the presence of the dielectric blocks were each effective to provide E-field enhancement. Other implementations of antennas utilizing the invention may employ one or the other of the third-dimensional element face feature or the dielectric material forward of the element face feature, or both such features. Thus, an antenna may include a two-dimensional type of disk having planar faces (e.g., as represented in the side edge view to the left in FIG. 4) with the presence of dielectric material (e.g., blocks

18*a* and 18*b* of FIG. 1). Alternatively, an antenna may include a disk having a third-dimensional characteristic (e.g., disk 14 of FIG. 1) without the presence of the dielectric forward of face feature. Skilled persons, once having an understanding of the invention, will be enabled to determine whether a particular one, or both, of such features are employed in particular antenna designs, as appropriate for particular applications. The invention makes possible improved performance through provision of a very wide-band antenna of compact size. Thus, in the context of a wideband radio application, for example, an antenna having a single input/output port provides the benefit of operation over a plurality of radio bands without the complexity of a band switching or matching network, thereby providing benefits in reducing complexity, losses and cost and increasing reliability.

Figure 5:
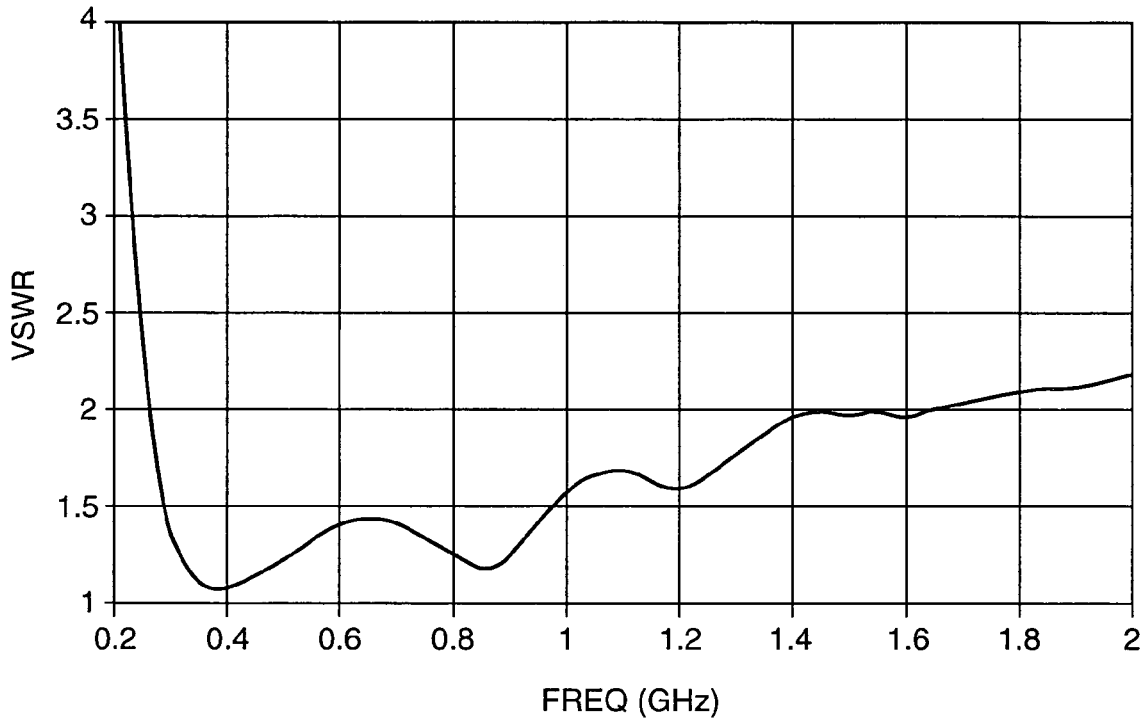
FIG. 5 shows data for computer simulation of VSWR vs. frequency from 0.2 to 2.0 GHz.
Figure 6:
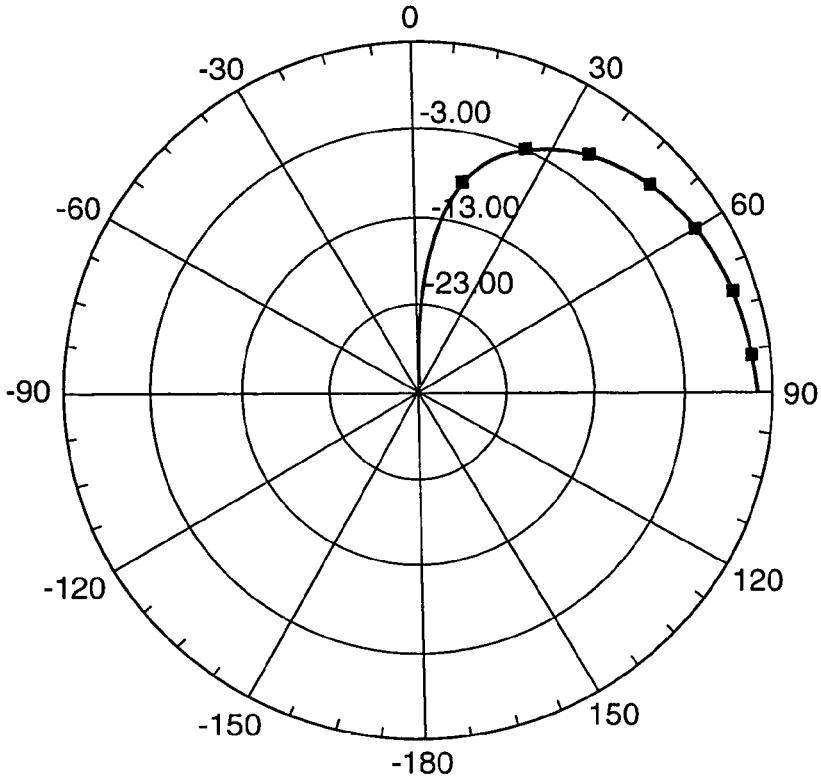
FIGS. 6 and 7 show data for computer simulation of the elevation pattern (directivity) at 0.2 and 2.0 GHz, respectively, for azimuth angles from 0 to 90 degrees, with 15 degree increments.
Figure 7:
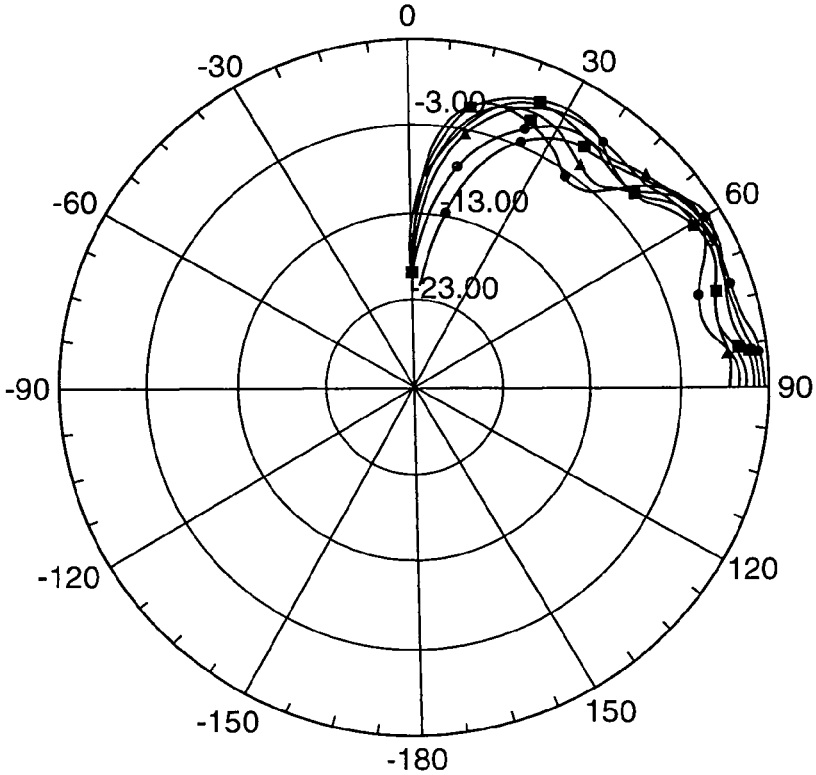
Figure 8:
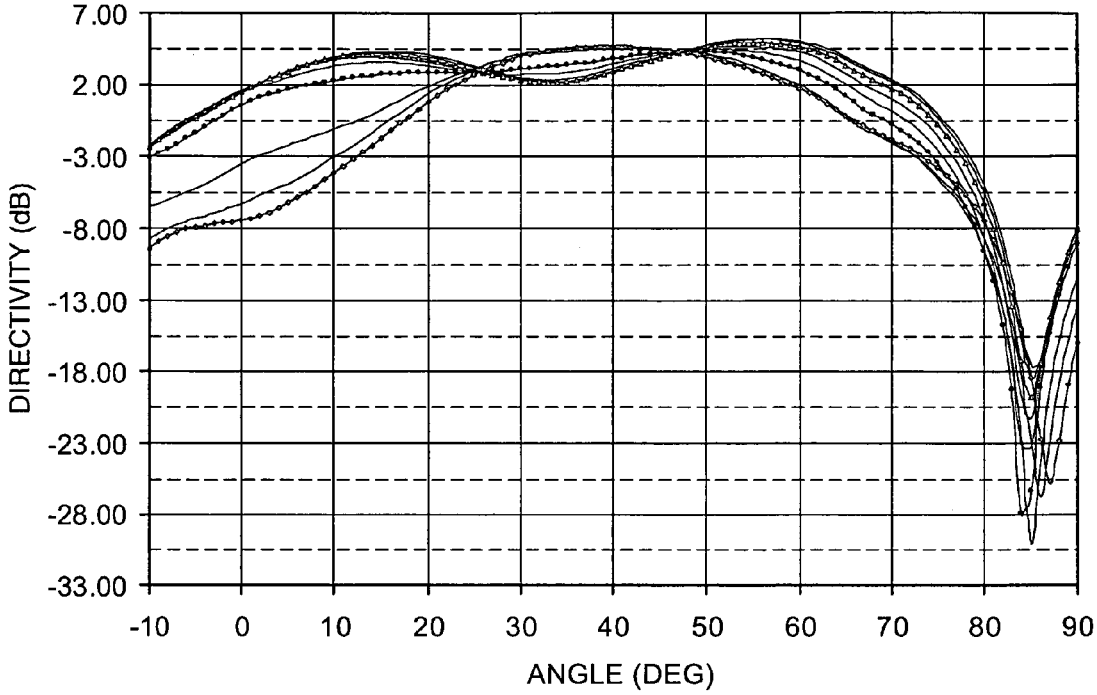
FIGS. 8 and 9 show measured data for the elevation pattern (directivity) at 1.3 and 2.0 GHz, respectively, for azimuth angles from 0 to 90 degrees, with 10 degree increments.
Figure 9:
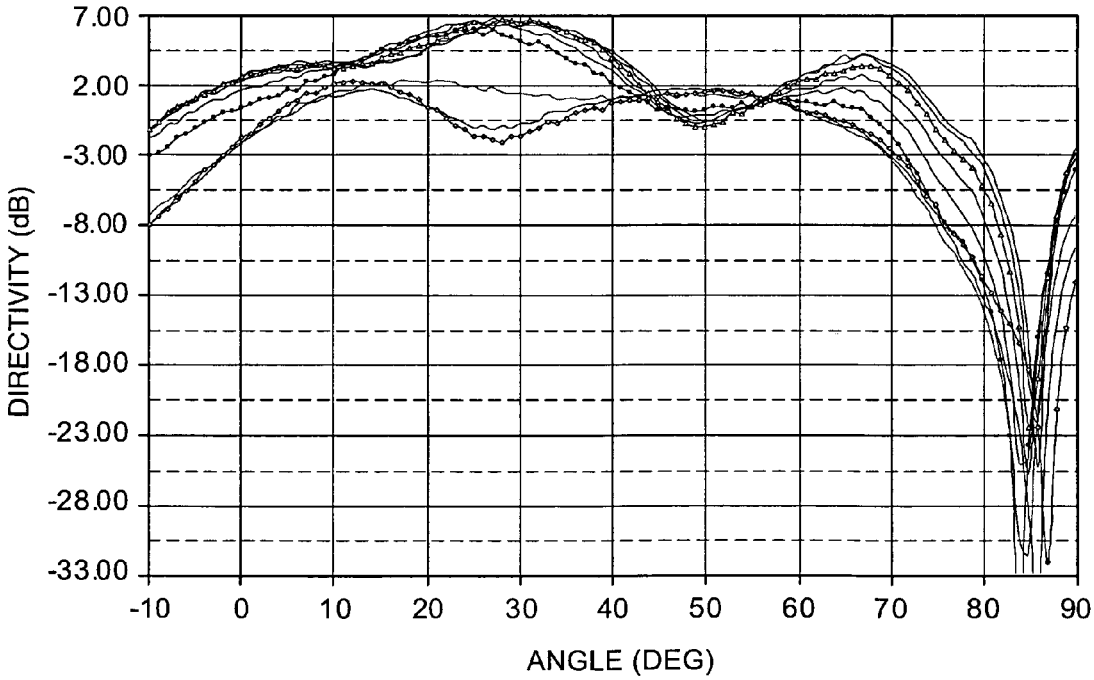

Performance for an antenna of the type shown in FIGS. 1, 2 and 3 was determined by computer simulation and by measurements using a ground plane section eight feet in diameter, with good agreement between the results obtained. FIG. 5 shows data for computer simulation of VSWR vs. frequency from 0.2 to 2.0 GHz. FIGS. 6 and 7 show data for computer simulation of the elevation pattern (directivity) at 0.2 and 2.0 GHz, respectively, for azimuth angles from 0 to 90 degrees, with 15 degree increments. As shown, there is good consistency over the range of elevations and data for intermediate frequencies was consistent with data for the frequency range end-points as represented by FIGS. 6 and 7. FIGS. 8 and 9 show measured data for the elevation pattern (directivity) at 1.3 and 2.0 GHz, respectively, for azimuth angles from 0 to 90 degrees, with 10 degree increments. As shown, there is good consistency over the range of elevations and data for intermediate frequencies was consistent with data for the frequency range end-points as represented by FIGS. 8 and 9.

While there have been described the currently preferred embodiments of the invention, those skilled in the art will recognize that other and further modifications may be made without departing from the invention and it is intended to claim all modifications and variations as fall within the scope of the invention.

What is claimed is:

1. An antenna comprising:

a ground plane section;

a radiating element having two faces each having a three-dimensional outer surface, the faces bounded by a two-dimensional circumference and the radiating element positioned with a chord of said circumference nominally perpendicular to said ground plane section;

dielectric material extending above the ground plane section with a portion of dielectric material forward of each said face of the radiating element; and a feed port coupled to the radiating element via an opening in said ground plane section.

2. An antenna as in claim 1, wherein each said face of the radiating element has a convex outer surface.

3. An antenna as in claim 1, wherein the radiating element has a face-to-face thickness at a point away from said circumference which is at least three times the thickness at said circumference.

4. An antenna as in claim 1, wherein the radiating element comprises a circular disk with each said face having a convex outer surface and the disk has a thickness at its center greater than thickness at said circumference.

5. An antenna as in claim 1, wherein the radiating element has the form of a disk which is thin at its circumference, has a greater face-to-face thickness at its center, and has a circumference which is one of: a circle, an ellipse, a square, a rectangle, a hexagon, another shape.

6. An antenna as in claim 1, wherein said dielectric material extends above the ground plane section by a dimension less than 10 percent of the largest dimension of the radiating element.

7. An antenna as in claim 1, wherein said dielectric material comprises two blocks of dielectric material with each block positioned on the ground plane surface in a forward direction relative to one face of the radiating element.

8. An antenna as in claim 7, wherein each said block of dielectric material extends above the surface of the ground plane section by a dimension less than 10 percent of the largest dimension of the radiating element.

9. An antenna comprising:

a ground plane section;

a radiating element having two faces bounded by a circumference, the radiating element positioned with a chord of said circumference nominally perpendicular to said ground plane section;

dielectric material extending above the ground plane section with a portion of dielectric material forward of each said face of the radiating element; and a feed port coupled to the radiating element via an opening in said ground plane.

10. An antenna as in claim 9, wherein the radiating element comprises a circular disk.

11. An antenna as in claim 9, wherein said circumference of the radiating element is one of: a circle, an ellipse, a square, a rectangle, a hexagon, another shape.

12. An antenna as in claim 9, wherein said dielectric material extends above the ground plane section by a dimension less than 10 percent of the largest dimension of the radiating element.

13. An antenna as in claim 9, wherein said dielectric material comprises two blocks of dielectric material with each block positioned on the ground plane surface in a forward direction relative to one face of the radiating element.

14. An antenna as in claim 13, wherein each said block of dielectric material extends above the surface of the ground plane section by a dimension less than 10 percent of the largest dimension of the radiating element.

* * * * *